US008608408B1

(12) United States Patent
Zou et al.

(10) Patent No.: US 8,608,408 B1
(45) Date of Patent: Dec. 17, 2013

(54) SECONDARY COLUMN ENHANCED TENSION LEG PLATFORM

(75) Inventors: Jun Zou, Katy, TX (US); Philip Poll, Houston, TX (US); John Chianis, Katy, TX (US)

(73) Assignee: Houston Offshore Engineering, LLC, Houston, TX (US)

( * ) Notice: Subject to any disclaimer, the term of this patent is extended or adjusted under 35 U.S.C. 154(b) by 66 days.

(21) Appl. No.: 12/985,123

(22) Filed: Jan. 5, 2011

Related U.S. Application Data

(60) Provisional application No. 61/292,279, filed on Jan. 5, 2010.

(51) Int. Cl.
*E02B 17/00* (2006.01)

(52) U.S. Cl.
USPC ..... 405/223.1; 405/224; 114/264

(58) Field of Classification Search
USPC ..... 405/203, 223.1, 224; 114/264
See application file for complete search history.

(56) References Cited

U.S. PATENT DOCUMENTS

| | | | | |
|---|---|---|---|---|
| 3,976,021 | A * | 8/1976 | Blenkarn et al. | 405/208 |
| 3,986,471 | A | 10/1976 | Haselton | |
| 3,996,755 | A | 12/1976 | Kalinowski | |
| 4,909,174 | A | 3/1990 | Bowes | |
| 4,987,846 | A | 1/1991 | Yamashita et al. | |
| 6,447,208 | B1 * | 9/2002 | Huang et al. | 405/224 |
| 6,503,023 | B2 | 1/2003 | Huang et al. | |
| 7,033,115 | B2 | 4/2006 | Huang et al. | |
| 2003/0113170 | A1 * | 6/2003 | Huang et al. | 405/206 |
| 2009/0114139 | A1 * | 5/2009 | Zou | 114/266 |

* cited by examiner

*Primary Examiner* — Benjamin Fiorello
(74) *Attorney, Agent, or Firm* — Buskop Law Group, PC; Wendy Buskop

(57) ABSTRACT

A tension leg platform for use in offshore hydrocarbon production and drilling operations, wherein the tension leg platform can include a plurality of column pairs. Each column pair can include a primary column connected with a secondary column and a secondary pontoon between the primary column and secondary column. The primary columns can be configured to support a deck, and the secondary columns can be connected with the primary column below the draft of the tension leg platform. The tension leg platform can also include a plurality of primary pontoons for connecting the primary columns to one another.

12 Claims, 6 Drawing Sheets

200
255
230
212
214
285
216
211
142
210
280
205
208
250
209

SECONDARY COLUMN ENHANCED TENSION LEG PLATFORM

SPECIFICATION

The present application claims priority to and the benefit of U.S. Provisional Patent Application Ser. No. 61/292,279 filed on Jan. 5, 2010, entitled "Secondary Column Enhanced Tension Leg Platform With Specified Upper Column Shape", which is incorporated herein in its entirety.

FIELD

The present embodiments generally relate to floating offshore oil and gas production and drilling facilities, but particularly those facilities with tension leg platform hull designs.

BACKGROUND

A need exists for a tension leg platform that can de-couple the need for setting optimized column to column spacing for deck support from the need to reduce deck steel weight and meet the stability requirements for pre-service conditions without temporary stability devices.

A further need exists for a tension leg platform that has tendon configurations in more efficient configurations to reduce the number of tendons and/or significantly save tendon weights.

Another need exists for a tension leg platform that has no temporary stability devices, or slanted columns for quayside integration and other pre-service conditions, and that uses conventional structural components with a conventional well bay.

A further need exists for a tension leg platform that has a specified column shape above the still water due to the latest revised metocean criteria, in more efficient configurations to reduce wave interactions and wave loads and thus reduce hull structure and tendon weights.

The present embodiments meet these needs.

BRIEF DESCRIPTION OF THE DRAWINGS

The detailed description will be better understood in conjunction with the accompanying drawings as follows.

Figure 1A:
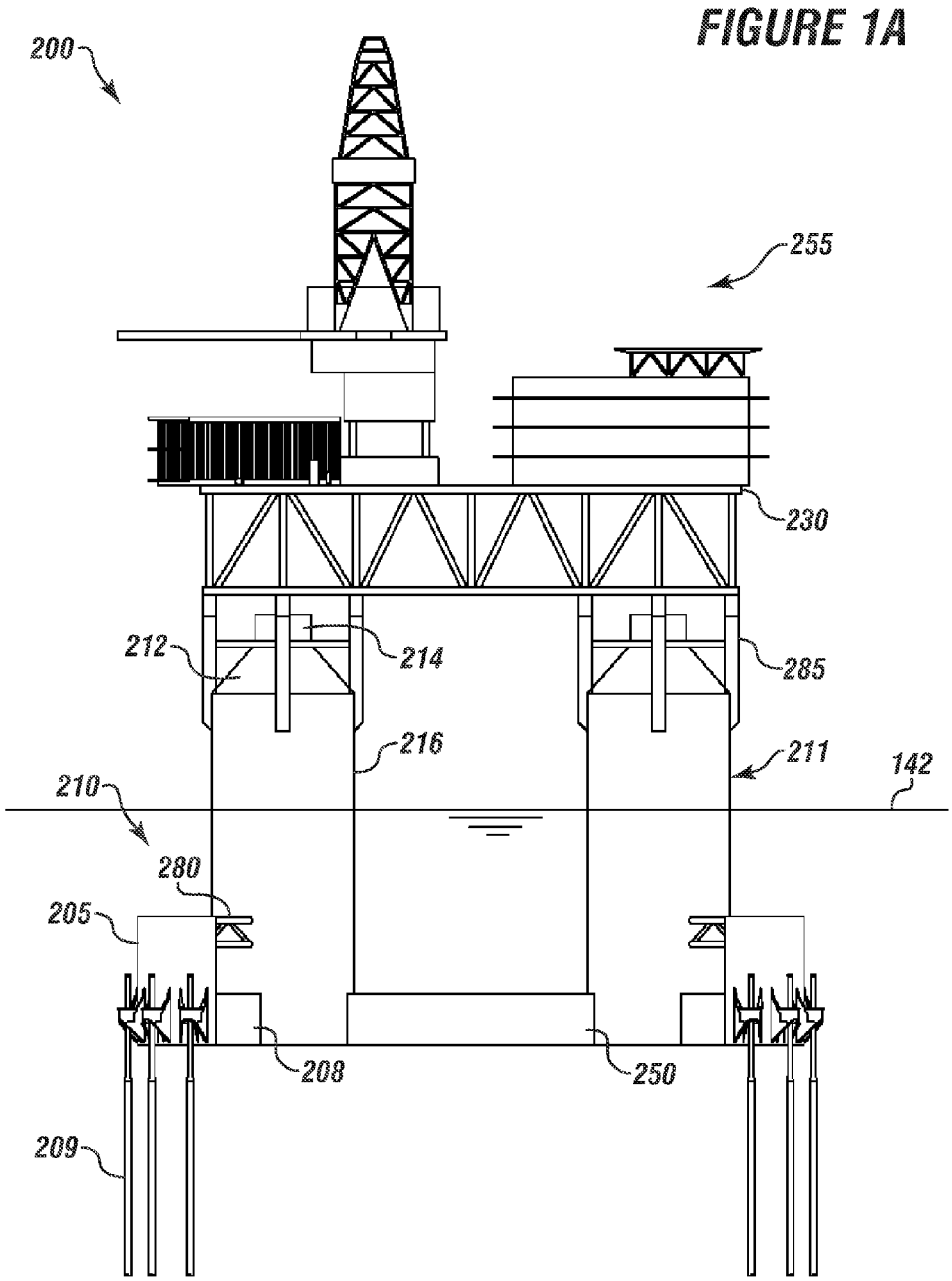
FIG. 1A depicts a tension leg platform having shaped primary columns according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to tension leg platforms for use in offshore hydrocarbon production and drilling operations.

In one or more embodiments, the tension leg platform can include a plurality of column pairs. For example there can be from about 3 column pairs to about 6 column pairs.

Each column pair can include a primary column permanently coupled to a secondary column, and a plurality of primary pontoons can couple the primary columns to one another. Furthermore, each column pair can include a secondary pontoon located between the primary column and the secondary column thereof. The secondary pontoon can be used to connect the primary column to the secondary column. Each secondary column can have from about 2 tendons to about 6 tendons attached thereto.

The primary columns can be configured to support a deck. The deck can support drilling equipment, production equipment, or combinations thereof. The secondary columns can be coupled to the primary column below the draft of the tension leg platform.

The primary columns can include an upper portion and a lower portion. A transition portion can be disposed between the lower portion and upper portion. The lower portion can have a larger diameter than the upper portion. The upper portion of each primary column can be secured to the deck by 1 deck post and up to 4 deck posts.

One or more embodiments of the tension leg platform can include a first primary column. The first primary column can be coupled to a second primary column by a first primary pontoon. In addition, a third primary column can be connected to the second primary column by a second primary pontoon. The third primary column can also be connected to the first primary column by a third primary pontoon.

A first secondary column can be permanently coupled to the first primary column. A second secondary column can be permanently coupled to the second primary column, and a third secondary column can be permanently coupled to the third primary column.

A first secondary pontoon can be located between the first primary column and the first secondary column, a second secondary pontoon can be located between the second primary column and the second secondary column, and a third secondary pontoon can be located between the third primary column and the third secondary column.

In one or more embodiments a first primary column can be coupled to a secondary primary column by a first primary pontoon. In addition, a third primary column can be connected to the second primary column by a second primary pontoon. The third primary column can also be connected to the fourth primary column by a third primary pontoon. The fourth primary column can be connected to the fourth primary column by a fourth primary pontoon.

A first secondary column can be permanently coupled to the first primary column. A second secondary column can be permanently coupled to the second primary column, a third secondary column can be permanently coupled to the third primary column, and a fourth secondary column can be permanently coupled to the fourth primary column.

The second column can help meet quayside integration and stability requirements of tension leg platform pre-service conditions without considering temporary stability devices and/or slanted columns.

A first secondary pontoon can be located between the first primary column and the first secondary column, a second secondary pontoon can be located between the second primary column and the second secondary column, a third secondary pontoon can be located between the third primary column and the third secondary column, and a fourth secondary pontoon can be located between the fourth secondary column and the fourth primary column.

Each column pair can also include a connection member for coupling the upper portion of the secondary column to the primary column. The connection member can be a truss, a solid plate, perforated plate, or combinations thereof. The connection member can be welded, bolted, or otherwise secured to the adjacent primary column and secondary column.

Figure 1B:
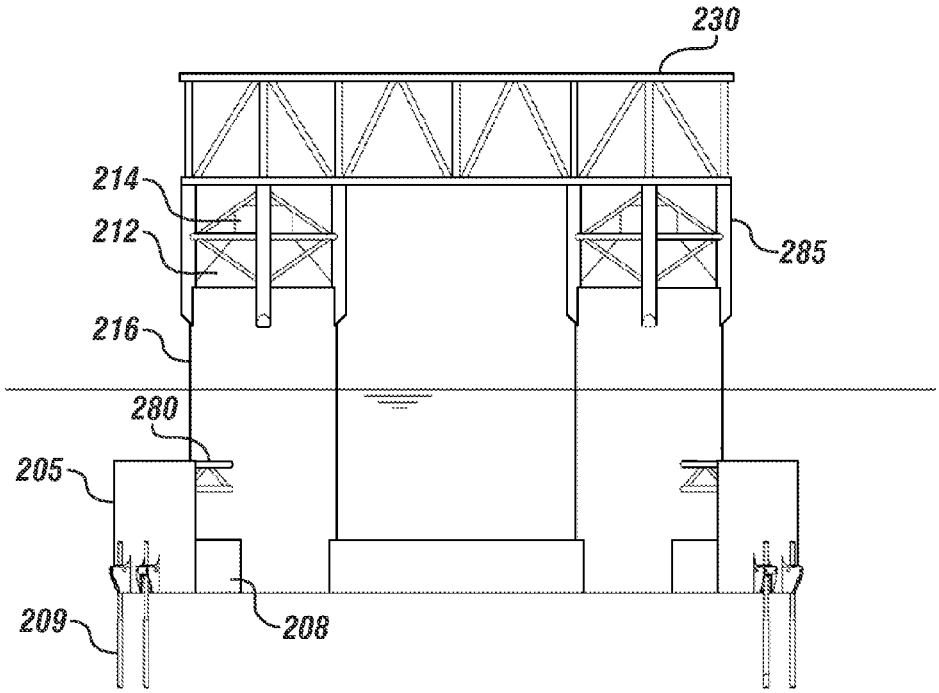
FIG. 1B depicts an elevation view of the tension leg platform of FIG. 1A.
Figure 1C:
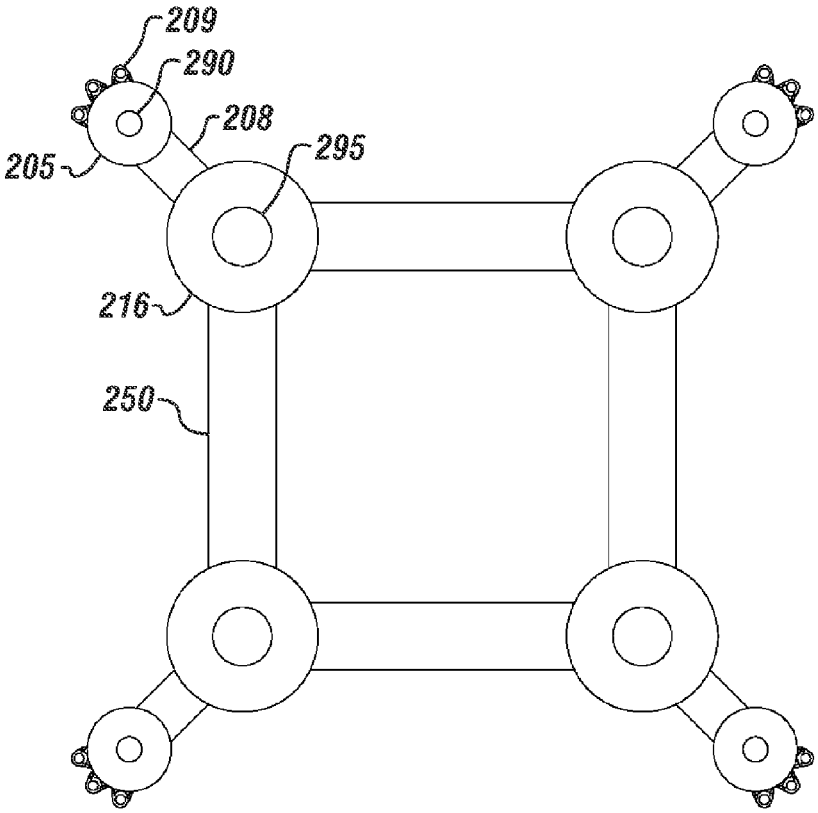
FIG. 1C depicts a cut view of the tension leg platform of FIG. 1A.

FIG. 1A depicts an embodiment of a tension leg platform 200 having shaped primary columns. FIG. 1B depicts an elevation view of the tension leg platform. FIG. 1C depicts a cut view of the tension leg platform 200.

Referring to FIGS. 1A-1C, the tension leg platform 200 can include a deck 230, one or more primary columns 211, one or more deck posts 285, and one or more secondary columns 205.

The deck 230 can support equipment 255, which can be similar to equipment described herein. The deck can be connected to the primary columns 211 by the deck posts 285. The deck posts 285 can be similar to one or more deck posts described herein. The primary columns 211 can include a primary column access shaft 295. The primary columns can include a lower portion 216, a transition portion 212, and an upper portion 214. The primary columns 211 can be configured to reduce the wave load experienced by the tension leg platform. The primary pontoons 250 can be similar to one or more pontoons disclosed herein.

The associated primary columns 211 and secondary columns 205 can form column pairs 210. The secondary columns 205, which can be similar to one or more secondary columns described herein and primary columns 211, can be permanently coupled to adjacent primary columns 211 by one or more connection members 280. The secondary columns 205 can be connected to the primary columns 211 below the water line 142. The secondary columns 205 can include secondary column access shaft 290. One or more tendons 209 can be connected to the secondary columns 205. One or more secondary pontoons 208, similar to one or more described herein, can be located between the primary columns 211 and the secondary columns 205.

Figure 2:
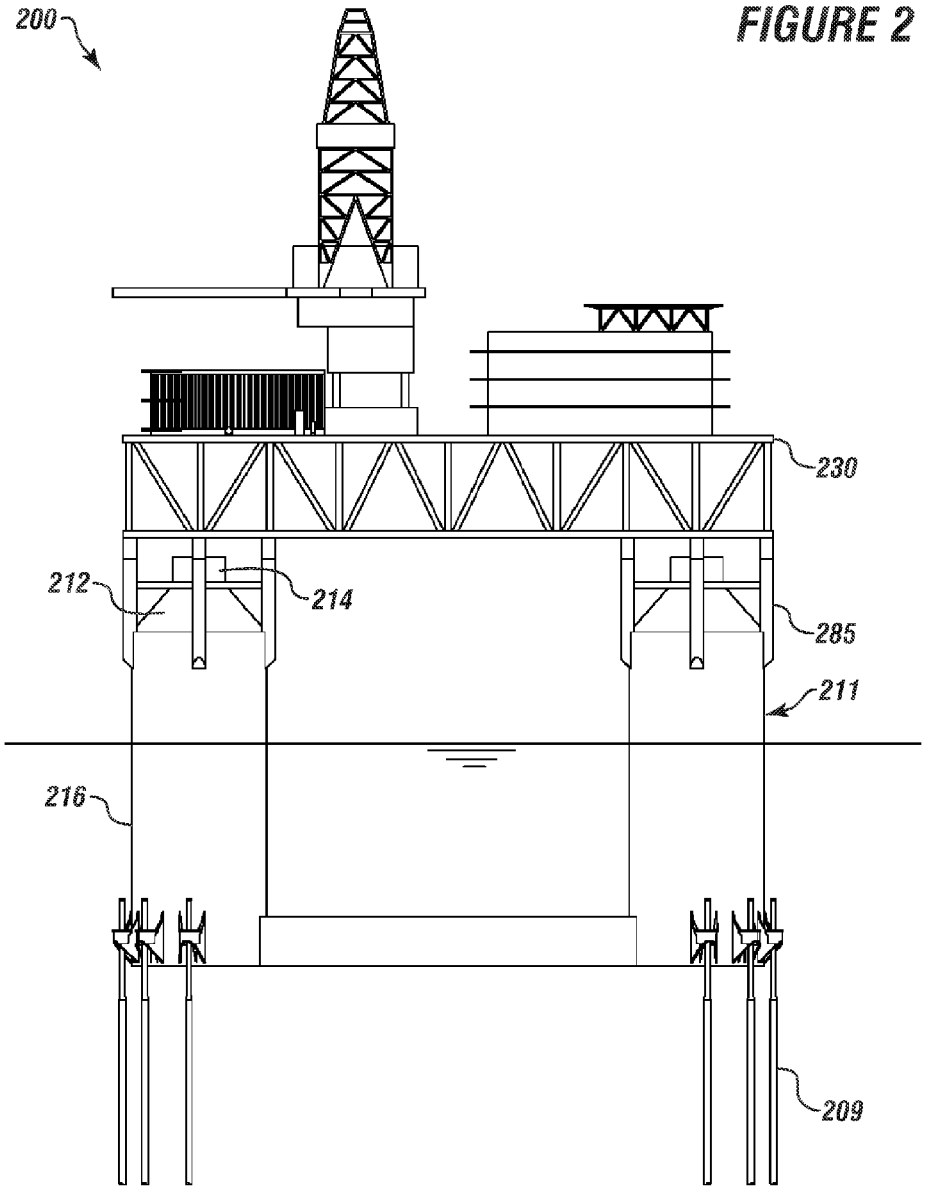
FIG. 2 depicts an embodiment of a tension leg platform according to one or more embodiments.

FIG. 2 depicts an embodiment of a tension leg platform 200 according to one or more embodiments. The tension leg platform 200 can include the deck 230, one or more primary columns 211, and one or more deck posts 285. The primary columns can include the lower portion 216, the transition portion 212, and the upper portion 214.

Tendons 209 can be associated with the primary columns 211. For example, a first tendon or set of tendons can be secured to a first primary column, a second tendon or set of tendons can be secured to a second primary column, a third tendon or set of tendons can be secured to a third primary column, and a fourth tendon or set of tendons can be secured to a fourth primary column.

The tendons can be individual tendons, sets of tendons or groups of tendons.

Figure 3:
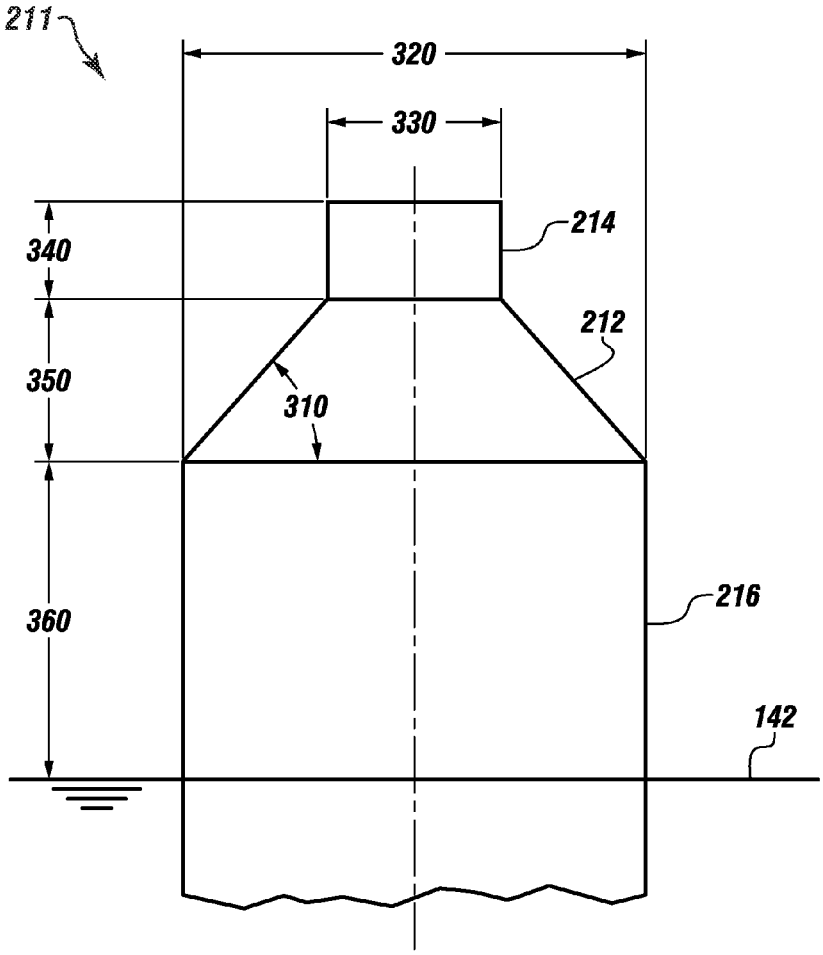
FIG. 3 depicts a detailed view of the primary column according to one or more embodiments.

FIG. 3 depicts a detailed view of the primary column 211 according to one or more embodiments.

The lower portion 216 can have a first diameter 320. The lower portion 216 can have a first height 360.

The transition portion 212 can transition the primary columns from the first diameter 320 to a second diameter 330. For example, the transition portion 212 can have an angle 310. The angle 310 can be from about 30 degrees to about 90 degrees. The transition portion 212 can have a second height 350.

The upper portion 214 can have the second diameter 330. The upper portion 214 can have a third height 340.

The second diameter 330 can be smaller to help reduce the impacts of overtopping. Overtopping discharge rate is a function of the first height 360, the second height 350, and the third height 340 as well as the second diameter 330. As such, the more the second diameter 330 is reduced the greater reduction in overtopping. This Figure also shows the water line 142.

The second diameter 330 can be smaller to help reduce the extreme wave loads. Extreme wave particle velocity distribution along the primary columns above mean water level is highly nonlinear. The wave crest particle velocities are significantly higher than those at mean water level. Wave loads are proportional to particle velocity square and projected area. As such, nonlinear high-frequency extreme wave loads can be reduced by 50 percent or more. The tendon responses are sensitive to the wave high-frequency excitations and may cause well-known "ringing" phenomena which will impact tendon strength and fatigue dramatically. With specified shape of primary columns, tendon extreme dynamic responses can be reduced significantly.

The second diameter 330 can be smaller to help reduce the extreme wave diffractions. Extreme waves passing the primary columns will be more transparent with less wave crest enhancements which help to reduce column freeboard to meet the minimum airgap requirements. As such, the hull structural weight will be reduced and tension leg platform pre-service stability will be benefited.

Due to hydrodynamic interactions between primary column and secondary column, tension leg platform surge/sway Response Amplitude Operators (RAOs) around fatigue periods can be optimized and improved. Thus, fatigue life of Steel Catenary Risers (SCRs) attached can be improved significantly.

Due to hydrodynamic interactions between primary column and secondary column, tendon tension Response Amplitude Operators (RAOs) around fatigue periods can be optimized and improved. Thus, tendon fatigue life can be improved significantly.

Figure 4:
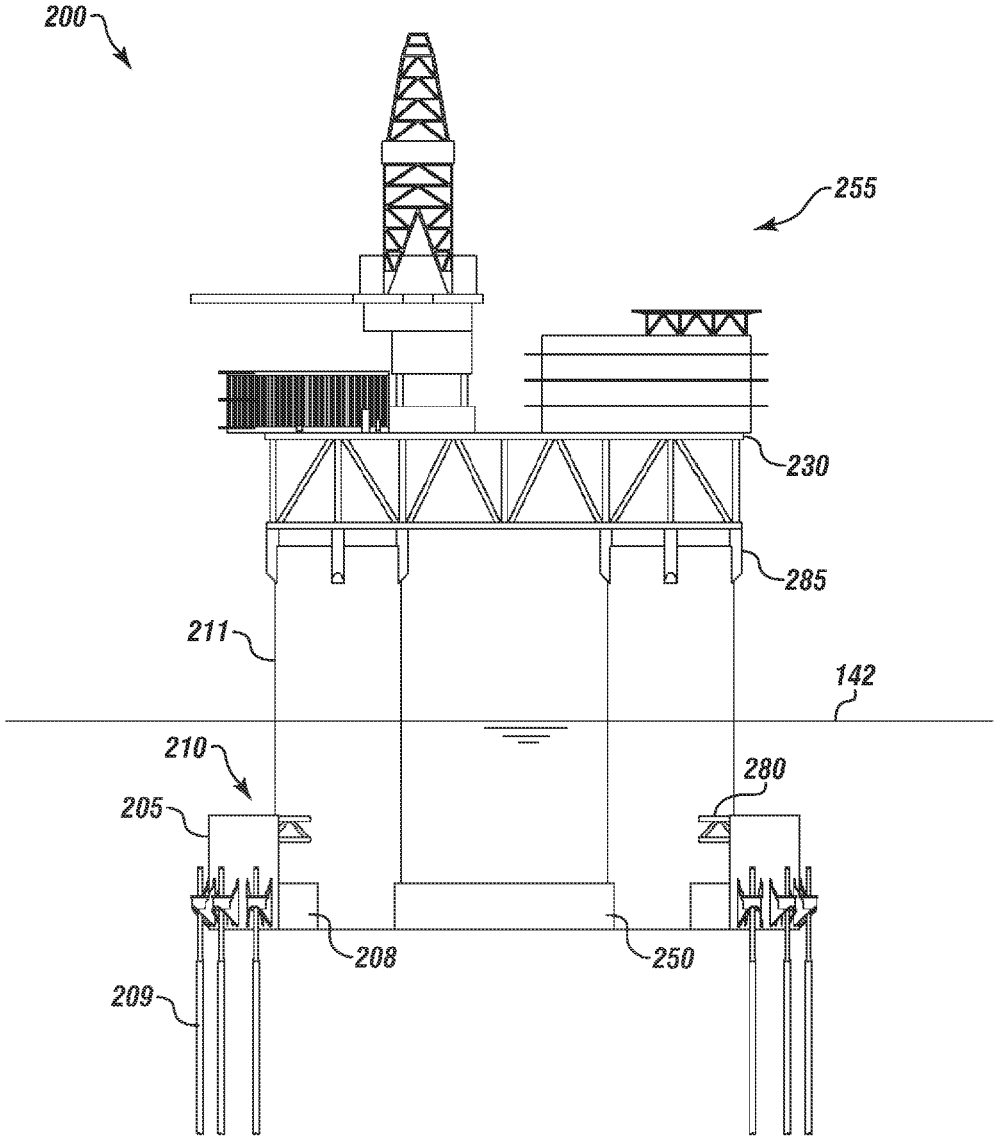
FIG. 4 depicts a tension leg platform according to one or more embodiments.

FIG. 4 depicts a tension leg platform according to one or more embodiments. The tension leg platform 200 can include a deck 230, one or more column pairs 210, and one or more primary pontoons 250.

The deck 230 can support equipment 255. The equipment 255 can be used for hydrocarbon production, drilling, or combinations thereof. Illustrative equipment can include mud pumps, derricks, boilers, generators, and the like.

The column pairs 210 can include a primary column 211. The primary column 211 can be coupled to a secondary column 205. For example, a connection member 280 can be used to permanently connect the primary column 211 to the secondary column 205. The secondary column 205 can be connected to the primary column 211 below the water line 142. The secondary column can have one or more tendons 209 connected thereto. The primary column 211 and the secondary column 205 can have a cylindrical shape, rectangular shape, square shape, or other shape.

The columns pairs 210 can also include a secondary pontoon 208 located between the primary column 211 and the secondary column 205. The secondary pontoon 208 can have any shape. For example, the secondary pontoon can be square, rectangular, cylindrical, or another shape.

The primary pontoons 250 can connect columns adjacent thereto to one another. For example, the primary pontoons 250 can connect to one column adjacent a left portion thereof and to another column adjacent to a right portion thereof. The primary pontoons can have any shape. For example, the primary pontoons can be square, rectangular, cylindrical, or another shape.

One or more deck posts 285 can secure the deck 230 to the primary columns 211. The deck posts 285 can be tubular, angle iron, c-channel, or the like.

While these embodiments have been described with emphasis on the embodiments, it should be understood that within the scope of the appended claims, the embodiments might be practiced other than as specifically described herein.

What is claimed is:

1. A tension leg platform for use in offshore hydrocarbon production and drilling operations, wherein the tension leg platform comprises:

a. a plurality of column pairs, wherein each column pair comprises a primary column connected with a secondary column by a secondary pontoon, wherein the plurality of column pairs remain connected after installation of the tension leg platform, wherein the primary columns are configured to support a deck, and wherein the secondary columns are connected with the primary columns below a draft of the tension leg platform, and wherein the secondary columns do not extend past the draft;

b. a plurality of primary pontoons for connecting the primary columns to one another; and c. wherein each secondary column of each column pair of the plurality of column pairs has a tendon connected therewith, wherein each tendon extends vertically from the secondary column associated therewith to an anchor on a sea floor.

2. The tension leg platform of claim 1, wherein each secondary column has two or more tendons attached thereto.

3. The tension leg platform of claim 1, wherein the plurality of column pairs comprises from 3 primary columns to 4 primary columns.

4. The tension leg platform of claim 1, wherein each column pair further comprises a connection member for connecting a portion of the secondary column to the primary column.

5. The tension leg platform of claim 4, wherein the connection member is a truss, a solid plate, a perforated plate, or combinations thereof.

6. The tension leg platform of claim 1, wherein the primary columns comprise an upper portion, a lower portion and a transition portion disposed between the lower portion and upper portion.

7. The tension leg platform of claim 6, wherein the lower portion of each primary column has a larger diameter than the upper portion.

8. The tension leg platform of claim 6, wherein the upper portion of each primary column is secured to the deck by at least 1 deck post and up to 4 deck posts.

9. A tension leg platform for use in offshore hydrocarbon production and drilling operations, wherein the tension leg platform comprises:

a. a first primary column, wherein the first primary column comprises: a first lower portion with a first lower portion diameter, a first upper portion with a first upper portion diameter, and a first transition portion connecting the first upper portion with the first lower portion, and wherein the first upper portion diameter is smaller than the first lower portion diameter;

b. a second primary column connected with the first primary column by a first primary pontoon wherein the second primary column comprises: a second lower portion with a second lower portion diameter, a second upper portion with a second upper portion diameter, and a second transition portion connecting the second upper portion with the second lower portion, and wherein the second upper portion diameter is smaller than the second lower portion diameter;

c. a third primary column connected with the second primary column by a second primary pontoon and to the first primary column by a third primary pontoon, wherein the third primary column comprises: a third lower portion with a third lower portion diameter, a third upper portion with a third upper portion diameter, and a third transition portion connecting the third upper portion with the third lower portion, and wherein the third upper portion diameter is smaller than the third lower portion diameter, wherein the primary columns support a deck;

d. a first secondary column connected with the first primary column, wherein the first secondary column is connected with the first primary column below a draft, and wherein the first secondary column does not extend above the draft; wherein each column pair further comprises a connection member for connecting a portion of the secondary column to the primary column;

e. a second secondary column connected with the second primary column, wherein the second secondary column is connected with the second primary column below the draft, and wherein the second secondary column does not extend above the draft;

f. a third secondary column connected with the third primary column, wherein the third secondary column is connected with the third primary column below the draft, and wherein the third secondary column does not extend above the draft;

g. a first secondary pontoon between the first primary column and the first secondary column, wherein the first secondary column is connected with the first primary column by the first secondary pontoon and a first connection member, wherein the first connection member is located between the top of the first secondary column and the first secondary pontoon;

h. a second secondary pontoon between the second primary column and the second secondary column, wherein the second secondary column is connected with the second primary column by the second secondary pontoon and the second connection member, wherein the second connection member is located between the top of the second secondary column and the second secondary pontoon;

i. a third secondary pontoon between the third primary column and the third secondary column, wherein the third secondary column is connected with the third primary column by the third secondary pontoon and the third connection member, wherein the third connection member is located between the top of the third secondary column and the third secondary pontoon;

j. a first tendon connected with the first secondary column, wherein the first tendon extends vertically from the first secondary column to a first anchor on a sea floor;

k. a second tendon connected with the second secondary column, wherein the second tendon extends vertically from the second secondary column to a second anchor on the sea floor; and l. a third tendon connected with the third secondary column, wherein the third tendon extends vertically from the third secondary column to a third anchor on the sea floor.

10. The tension leg platform of claim 9, further comprising production equipment operatively disposed on the deck.

11. The tension leg platform of claim 9, further comprising drilling equipment operatively disposed on the deck.

12. A tension leg platform for use in offshore hydrocarbon production and drilling operations, wherein the tension leg platform comprises:

a. a first primary column, wherein the first primary column comprises: a first lower portion with a first lower portion diameter, a first upper portion with a first upper portion diameter, and a first transition portion connecting the first upper portion with the first lower portion, and wherein the first upper portion diameter is smaller than the first lower portion diameter;

b. a second primary column connected with the first primary column by a first primary pontoon wherein the second primary column comprises: a second lower portion with a second lower portion diameter, a second upper portion with a second upper portion diameter, and a second transition portion connecting the second upper portion with the second lower portion, and wherein the second upper portion diameter is smaller than the second lower portion diameter;

c. a third primary column connected with the second primary column by a second primary pontoon, wherein the third primary column comprises: a third lower portion with a third lower portion diameter, a third upper portion with a third upper portion diameter, and a third transition portion connecting the third upper portion with the third lower portion, and wherein the third upper portion diameter is smaller than the third lower portion diameter;

d. a fourth primary column connected with the third primary column by a third primary pontoon and to the first primary column by a fourth primary pontoon, wherein the fourth primary column comprises: a fourth lower portion with a fourth lower portion diameter, a fourth upper portion with a fourth upper portion diameter, and a fourth transition portion connecting the fourth upper portion with the fourth lower portion, and wherein the fourth upper portion diameter is smaller than the fourth lower portion diameter;

e. a first secondary column connected with the first primary column, wherein the first secondary column is connected with the first primary column below a draft, and wherein the first secondary column does not extend above the draft;

f. a second secondary column connected with the second primary column, wherein the second secondary column is connected with the second primary column below the draft, and wherein the second secondary column does not extend above the draft;

g. a third secondary column connected with the third primary column, wherein the third secondary column is connected with the third primary column below the draft, and wherein the third secondary column does not extend above the draft;

h. a fourth secondary column connected with the fourth primary column, wherein the fourth secondary column is connected with the fourth primary column below the draft, and wherein the fourth secondary column does not extend above the draft;

i. a first secondary pontoon between the first primary column and the first secondary column, wherein the first secondary column is connected with the first primary column by the first secondary pontoon and a first connection member, wherein the first connection member is located between the top of the first secondary column and the first secondary pontoon;

j. a second secondary pontoon between the second primary column and the second secondary column, wherein the second secondary column is connected with the second primary column by the second secondary pontoon and the second connection member, wherein the second connection member is located between the top of the second secondary column and the second secondary pontoon;

k. a third secondary pontoon between the third primary column and the third secondary column, wherein the third secondary column is connected with the third primary column by the third secondary pontoon and the third connection member, wherein the third connection member is located between the top of the third secondary column and the third secondary pontoon;

l. a fourth secondary pontoon between the fourth primary column and the fourth secondary column, wherein the fourth secondary column is connected with the fourth primary column by a fourth secondary pontoon and a fourth connection member, wherein the fourth connection member is located between the top of the fourth secondary column and the fourth secondary pontoon;

m. a first tendon connected with the first secondary column, wherein the first tendon extends vertically from the first secondary column to a first anchor on a sea floor;

n. a second tendon connected with the second secondary column, wherein the second tendon extends vertically from the second secondary column to a second anchor on the sea floor;

o. a third tendon connected with the third secondary column, wherein the third tendon extends vertically from the third secondary column to a third anchor on the sea floor; and p. a fourth tendon connected with the fourth secondary column, wherein the fourth tendon extends vertically from the fourth secondary column to a fourth anchor on the sea floor.

* * * * *